US008350492B2

(12) United States Patent
Lim et al.

(10) Patent No.: US 8,350,492 B2
(45) Date of Patent: Jan. 8, 2013

(54) DRIVER FOR BACKLIGHT UNIT

(75) Inventors: Jong Ho Lim, Daegu (KR); Kyu Bong Jung, Chuncheon-si (KR); Young Kyu Park, Paju-si (KR); Bong Koo Kang, Pohang-si (KR)

(73) Assignees: LG Display Co., Ltd., Seoul (KR); Postech Academy-Industry Foundation, Pohang-Si (KR)

( * ) Notice: Subject to any disclaimer, the term of this patent is extended or adjusted under 35 U.S.C. 154(b) by 302 days.

(21) Appl. No.: 12/588,769

(22) Filed: Oct. 27, 2009

(65) Prior Publication Data

US 2010/0117551 A1 May 13, 2010

(30) Foreign Application Priority Data

Oct. 28, 2008 (KR) ..... 10-2008-0106176

(51) Int. Cl.
*H05B 41/36* (2006.01)

(52) U.S. Cl. ..... 315/291; 315/224; 315/254; 315/307; 315/308; 315/311; 345/90; 345/96; 345/102; 345/204; 345/214

(58) Field of Classification Search ..... 315/224, 315/254, 276, 291, 300, 307, 308, 311; 345/90, 345/96, 102, 204, 211–214
See application file for complete search history.

(56) References Cited

U.S. PATENT DOCUMENTS

| | | | | |
|---|---|---|---|---|
| 6,420,839 | B1 * | 7/2002 | Chiang et al. | 315/311 |
| 6,922,023 | B2 * | 7/2005 | Hsu et al. | 315/291 |
| 7,026,860 | B1 * | 4/2006 | Gheorghiu et al. | 327/513 |
| 7,042,171 | B1 * | 5/2006 | Lin | 315/291 |
| 7,268,501 | B1 * | 9/2007 | Chen | 315/291 |
| 7,372,213 | B2 * | 5/2008 | Kuo et al. | 315/282 |
| 2004/0100438 | A1 * | 5/2004 | Lee et al. | 345/102 |
| 2008/0067994 | A1 * | 3/2008 | Kesterson et al. | 323/283 |
| 2008/0116821 | A1 * | 5/2008 | Weger et al. | 315/250 |
| 2008/0137384 | A1 | 6/2008 | Lin et al. | |

FOREIGN PATENT DOCUMENTS

| | | |
|---|---|---|
| CN | 101202516 A | 6/2008 |
| WO | WO 2008/050679 A1 | 5/2008 |

* cited by examiner

*Primary Examiner* — Douglas W Owens
*Assistant Examiner* — Thai Pham
(74) *Attorney, Agent, or Firm* — McKenna Long & Aldridge LLP

(57) ABSTRACT

A backlight unit, with a parallel configuration of plural lamps, having improved reliability is disclosed. The backlight unit driver includes: first and second lamps connected parallel to each other; a DC/AC inversion portion inverting a DC voltage into an AC voltage to apply the AC voltage to the lamps; a transformer transforming the AC voltage from the DC/AC inversion portion; a positive polarity AC signal compensator compensating an electric current difference between the first and second lamps using positive polarity AC signals from the first and second lamps; and a negative polarity AC signal compensator compensating the electric current difference between the first and second lamps using negative polarity AC signals from the first and second lamps.

5 Claims, 3 Drawing Sheets

DRIVER FOR BACKLIGHT UNIT

CROSS-REFERENCE TO RELATED APPLICATION

This application claims priority under 35 U.S.C. 119 to Korean Patent Application No. 10-2008-0106176, filed on Oct. 28, 2008, which is hereby incorporated by reference in its entirety for all purposes.

BACKGROUND OF THE INVENTION

1. Field of the Disclosure

This disclosure is related to a backlight unit, and particularly to a light driver capable of preventing a current deviation between a plurality of lamps which are connected to one another in the backlight unit.

2. Description of the Related Art

A cathode ray tube (CRT) is one among a wide number of display devices and is mainly employed in the monitors of television receivers, measuring instruments, and information terminals. (I don't understand what you mean by 'information terminals') It is difficult to apply the CRT to small and light electronic products, because of its weight and size. In other words, the CRT has a limit due to its weight and size while the trend for electronic products is to be light-weight and small in size.

To address this matter, a liquid crystal display (LCD) device using an electro-optical effect, a plasma display panel (PDP) using a gas discharge, and an electro-luminescent display (ELD) device using an electro-luminescent effect are expected to substitute for the CRT. Among these devices, the LCD device has actively been developed.

The LCD device controls an amount of incident light from the exterior in order to display a picture. The LCD device necessarily requires a separate light source, such as a backlight unit, irradiating on the LCD panel because it is a light receiving device. The backlight unit employed in the LCD device as the light source can be classified as either an edge type or a direct type in accordance with the disposition of a cylindrical emission lamp.

The edge type backlight unit includes a lamp unit on the side surface of a light guide panel guiding light. The lamp unit includes a light emitting lamp, lamp holders receiving both ends of the lamp in order to protect the lamp, and a lamp reflection plate reflecting light emitted from the lamp toward the light guide panel. The lamp reflection plate surrounds the outer circumferential surface of the lamp and has an edge portion which is inserted in the side surface of the light guide panel.

Such an edge type backlight unit with the lamp unit installed on the side surface of the light guide panel is mainly applied to comparatively small-sized LCD devices such as the monitors of laptops and desk-top computers. The edge type backlight unit has good light uniformity, a lengthened lifespan, and the advantage of thinning the LCD device.

The direct type backlight unit has begun to be concentrically developed as the LCD device is enlarged to a size above 20 inches. The direct type backlight unit forces light to be irradiated onto the entire surface of the LCD panel. To this end, the direct type backlight unit includes a plurality of lamps arranged in a row (or side by side) on the inner surface of a bottom cover.

Since the direct type backlight unit has a higher light efficiency than the edge type backlight unit, it is mainly used for LCD devices of a large size which require a high brightness.

In such a direct type backlight unit, the plural lamps arranged at a constant distance are electrically connected to an external inverter, which is installed on the outside of the backlight unit, via a common electrode. In other words, the plural lamps are connected parallel to one another.

The inverter includes a transformer applying an electric power of alternating current to an output terminal and a balance capacitor disposed between the secondary terminal of the transformer and the end terminals of the lamps. The balance capacitor controls an electric current to be applied to each lamp and uniformly balances the electric current. Also, the balance capacitor matches the lamps and the output side of the inverter in impedance.

However, the electric current applied to each of the lamps is not uniform when the related art backlight unit is driven by the inverter. This results from an unbalance between the impedance components of the balance capacitor and an equivalent capacitor of the lamp. In other words, although the related art backlight unit includes the balance capacitor, it does not maintain a uniform brightness in each region.

SUMMARY OF THE INVENTION

Accordingly, the present embodiments are directed to a backlight unit that substantially obviates one or more of problems due to the limitations and disadvantages of the related art.

An object of the present embodiment is to provide a backlight unit driver that is adapted to prevent a deviation between (or among) electric currents applied to plural lamps which are connected parallel to one another.

According to a general aspect of present embodiment, a backlight unit driver includes: first and second lamps connected parallel to each other; a DC/AC inversion portion inverting a DC voltage into an AC voltage to apply the AC voltage to the lamps; a transformer transforming the AC voltage from the DC/AC inversion portion; a positive polarity AC signal compensator compensating an electric current difference between the first and second lamps using positive polarity AC signals from the first and second lamps; and a negative polarity AC signal compensator compensating the electric current difference between the first and second lamps using negative polarity AC signals from the first and second lamps.

Additional features and advantages of the embodiments will be set forth in the description which follows, and in part will be apparent from the description, or may be learned by practice of the embodiments. The advantages of the embodiments will be realized and attained by the structure particularly pointed out in the written description and claims hereof as well as the appended drawings.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated in and constitute a part of this application, illustrate embodiment(s) of the invention and together with the description serve to explain the disclosure. In the drawings.

DETAILED DESCRIPTION

Figure 1:
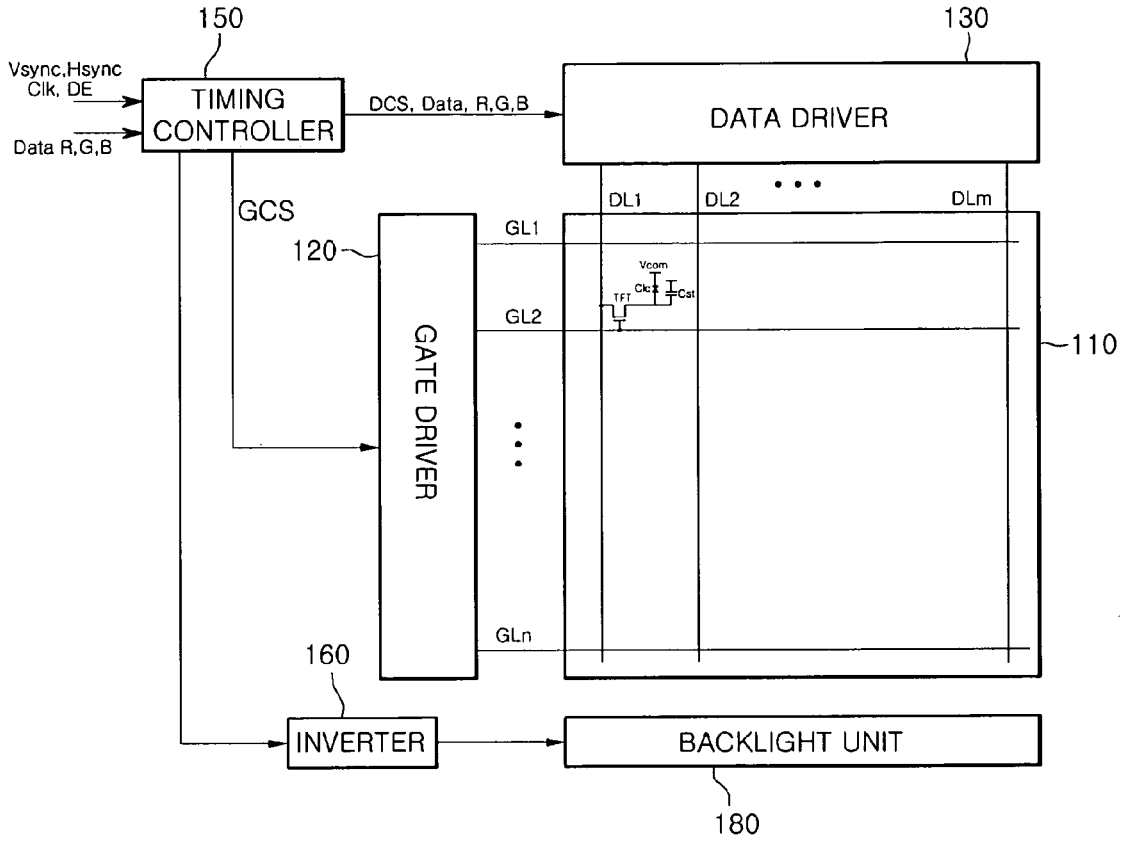
FIG. 1 is a view schematically showing an LCD device according to an embodiment of the present disclosure.

Reference will now be made in detail to the embodiments of the present disclosure, examples of which are illustrated in the accompanying drawings. These embodiments introduced hereinafter are provided as examples in order to convey their spirits to the ordinary skilled person in the art. Therefore, these embodiments might be embodied in a different shape, so are not limited to these embodiments described here. Also, the size and thickness of the device might be expressed to be exaggerated for the sake of convenience in the drawings. Wherever possible, the same reference numbers will be used throughout this disclosure including the drawings to refer to the same or like parts.

Figure 2:
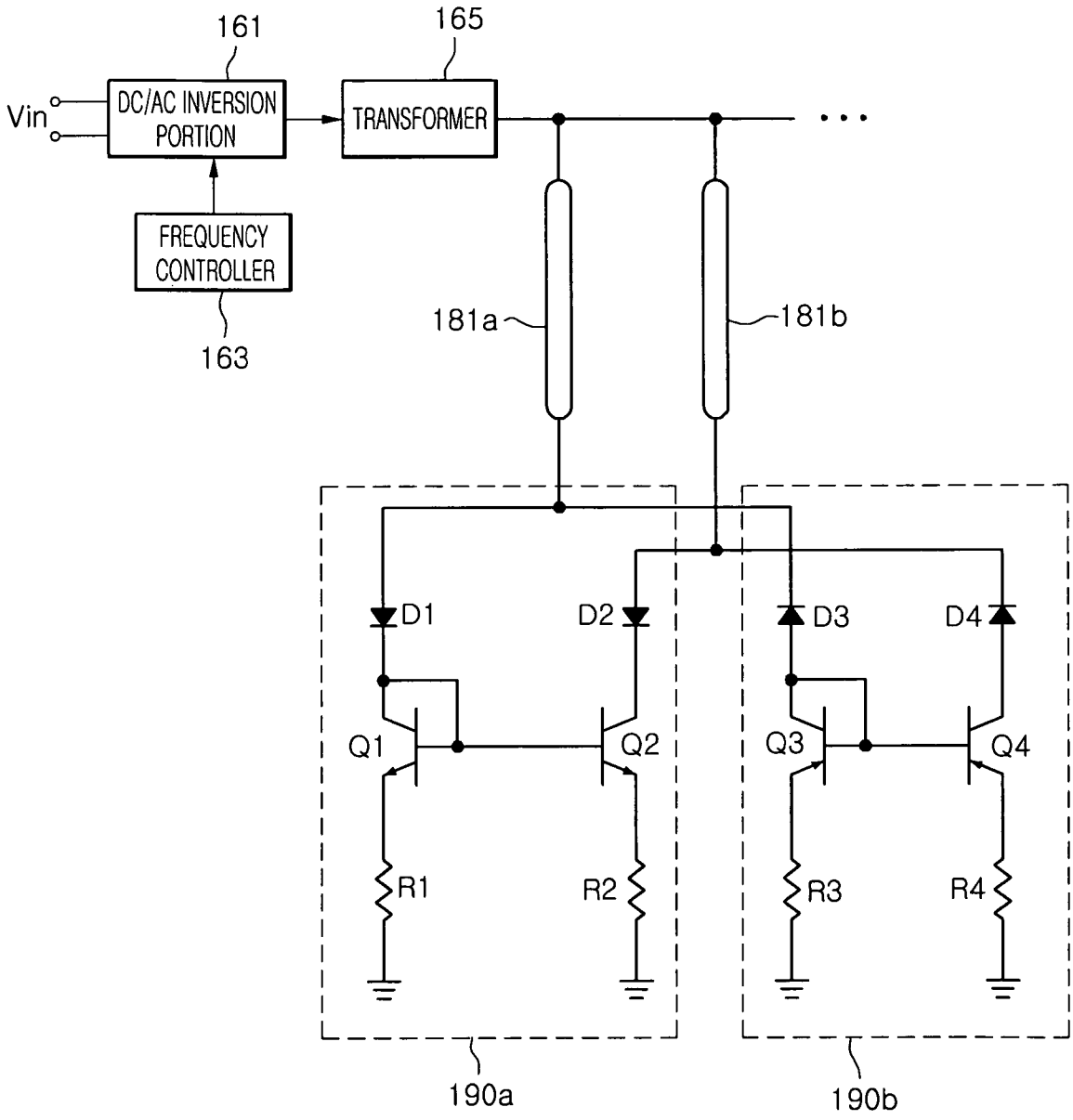
FIG. 2 is a view showing the configuration of the inverter of FIG. 1.

FIG. 1 is a view schematically showing an LCD device according to an embodiment of the present disclosure. FIG. 2 is a view showing the configuration of the inverter of FIG. 1.

Referring to FIGS. 1 and 2, the LCD device according to the embodiment of the present disclosure includes: a LCD panel 110 on which gate lines GL1 to GLn and data lines DL1 to DLm cross each other; a gate driver 120 applying scan pulses to the gate lines GL1 to GLn on the LCD panel 110; a data driver 130 applying data signals to the data lines DL1 to DLm on the LCD panel 110; and a timing controller 150 controlling the gate driver 120 and the data driver 130. The LCD panel 110 includes thin film transistors TFT each formed at intersections of the gate lines GL1 to GLn and the data lines DL1 to DLm. The thin film transistors TFT drive liquid crystal cells Clc, respectively.

The LCD device further includes a backlight unit 180 applying light to the LCD panel 110 in accordance with a control signal from the timing controller 150, and an inverter 160 driving the backlight unit 180 in response to another control signal from the timing controller 150.

Although it is not shown in the drawings, the LCD device also includes a common voltage generator outputting a common voltage Vcom and a power supply unit applying a power supply voltage to each of the elements as described above.

The thin film transistors TFT on the LCD panel 110 are formed opposite the liquid crystal cells Clc and function as switching elements. To this end, each thin film transistor TFT includes a gate electrode connected to the respective gate line GL, a source electrode connected to the respective data line DL, and a drain electrode connected to a pixel electrode of the respective liquid crystal cell Clc and one side electrode of respective storage capacitor Cst. The common voltage Vcom is applied to a common electrode which is generally employed in the liquid crystal cells Clc. The storage capacitor Cst charges the data signal on the respective data line DL upon the turning on of the respective thin film transistor, thereby stably maintaining a voltage charged in the respective liquid crystal cell Clc.

Also, each of the thin film transistors TFT is turned on and forms a channel between its source and drain electrodes when the scan pulse is applied to the respective gate line GL. At this time, the data voltage on the data line DL is applied to the pixel electrode of the respective liquid crystal cell Clc via the formed channel. Accordingly, the liquid crystal molecules of the liquid crystal cell Clc are aligned by an electric field between the pixel electrode and the common electrode in a different shape, and modulate incident light.

The gate driver 120 derives the sequential scan pulses from a gate drive control signal GCS which is applied from the timing controller 150. The gate pulses are sequentially supplied to the gate lines GL1 to GLn. In this case, the gate drive control signal GCS may include a gate start pulse GSP, at least one gate shift clock GSC, and a gate output enable signal GOE.

The data driver 130 responds to a data drive control signal DCS and applies the data signals to the data lines DL1 to DLm. To this end, the data driver 130 samples and latches image data R, G, and B input from the timing controller 150, opposite to the data lines DL1 to DLm, and converts the image data R, G, and B into an analog data signal using gamma reference voltages. The gamma reference voltages are generated in a gamma reference voltage generator (not shown) and are applied to the data driver 130 through a gamma reference voltage selector (not shown). The analog data signal may be displayed in a variety of gradations by the liquid crystal cell on the LCD panel 110. The data drive control signal DCS may include a source start pulse SSP, a source shift clock SSC, a source output enable signal SOE, a polarity inversion signal POL, and so on.

The timing controller 150 receives a vertical synchronous signal Vsync, a Horizontal synchronous signal Hsync, a clock signal clk, a data enable signal DE, and the image data R, G, and B from an external system. Also, the timing controller 150 generates the control signals GCS and DCS controlling the gate and data drivers 120 and 130, using the vertical synchronous signal Vsync, the Horizontal synchronous signal Hsync, the clock signal clk, and the data enable signal DE.

The backlight unit 180 applies light on the LCD panel 110. To this end, the backlight unit 180 includes a plurality of cold cathode fluorescent lamps (CCFLs) or external electrode fluorescent lamps (EEFLs).

The inverter 160 inverts a direct current electric power from the exterior into the alternating current (AC) electric power of fixed frequency and voltage level which is adapted to drive the lamps of the backlight unit 180. To this end, the inverter 160 may include a DC/AC inversion portion 161, a transformer 165, a frequency controller 163, a positive polarity AC signal compensator 190A, and a negative polarity AC signal compensator 190B.

The DC/AC inversion portion 161 inverts the DC electric power Vin from the exterior into the AC electric power. The inverted AC electric power is applied to a primary coil of the transformer 165. To this end, the DC/AC inversion portion 161 may include two switching elements which are turned on and off alternately and complementarily to each other.

The transformer 165 includes a primary coil connected to the DC/AC inversion portion 161 and a secondary coil connected to one end of the first and second lamps 181*a* and 181*b*. Such a transformer 165 transforms the AC voltage from the DC/AC inversion portion 161 into a high AC voltage and drives the first and second lamps 181*a* and 182 using the transformed AC voltage. More specifically, the transformer 165 boosts the AC voltage at its first coil as a winding ratio of the first and second coils, so that the boosted AC voltage is induced at its secondary coil.

The frequency controller controls the DC/AC inversion portion 161 to stably output the AC voltage of a fixed frequency.

The positive and negative polarity AC signal compensators 190*a* and 190*b* are commonly connected to the other ends of the first and second lamps 181*a* and 181*b* in order to maintain the AC signals (i.e., electric currents) flowing through the first and second lamps 181*a* and 181*b*.

The positive polarity AC signal compensator 190*a* includes first and second diodes D1 and D2 connected to the other ends of the first and second lamps 181*a* and 181*b*, a first transistor Q1 connected to the first diode D1, and a second transistor Q2 connected to the second diode D2. In this case, the first and second diodes D1 and D2 are shorted when a positive polarity AC signal is input. Also, the first and second transistors Q1 and Q2 may be N-type transistors.

The first transistor Q1 includes a collect electrode connected to the first diode D1, and an emitter electrode connected to a first resistor R1. The collect and base electrodes of the first transistor Q1 are connected to each other. The first resistor R1 is connected to a ground electric current source.

The second transistor Q2 includes a collect electrode connected to the second diode D2, the base electrode connected to the base electrode of the first transistor Q1, and an emitter electrode connected to a second resistor R2. The second resistor R2 is connected to the ground electric current source.

If the positive polarity AC signal is applied to the first and second lamps 181*a* and 181*b*, the first and second diodes D1 and D2 included in the positive polarity AC signal compensator 190*a* are shorted so that the first and second transistors Q1 and Q2 are turned on. In this case, an electric current difference between the positive polarity AC signals flowing through the first and second lamps 181*a* and 181*b* is minimized or is not generated. This results from the fact that the collect and base electrodes of the first transistor Q1 are connected with each other and the base electrodes of the first and second transistor Q2 are connected with each other.

In this way, the positive polarity AC signal compensator 190*a* operates as a current mirror, by means of the shorted first and second diodes D1 and D2, when the positive polarity AC signal is applied to the first and second lamps 181*a* and 181*b*. Accordingly, the electric current difference between the positive polarity AC signals through the first and second lamps 181*a* and 181*b* of a parallel connection configuration can be prevented or minimized.

On the other hand, the negative polarity AC signal compensator 190*b* includes third and fourth diodes D3 and D4 connected to the other ends of the first and second lamps 181*a* and 181*b*, a third transistor Q3 connected to the third diode D3, and a fourth transistor Q4 connected to the fourth diode D4. In this case, the third and fourth diodes D3 and D4 are shorted on when a negative polarity AC signal is input. Also, the third and fourth transistors Q3 and Q4 may be P-type transistors.

The third transistor Q3 includes a collect electrode connected to the third diode D3, and an emitter electrode connected to a third resistor R3. The collect and base electrodes of the third transistor Q3 are connected to each other. The third resistor R3 is connected to the ground electric current source.

The fourth transistor Q4 includes a collect electrode connected to the fourth diode D4, the base electrode connected to the base electrode of the third transistor Q3, and an emitter electrode connected to a fourth resistor R4. The fourth resistor R4 is connected to the ground electric current source.

When the negative polarity AC signal is applied to the first and second lamps 181*a* and 181*b*, the third and fourth diodes D3 and D4 included in the negative polarity AC signal compensator 190*b* are shorted so that the third and fourth transistors Q3 and Q4 are turned on. At this time, an electric current difference between the negative polarity AC signals flowing through the first and second lamps 181*a* and 181*b* is minimized or is not generated. This results from the fact that the collect and base electrodes of the third transistor Q3 are not only connected with each other but the base electrodes of the third and fourth transistors Q3 and Q4 are also connected with each other.

In this manner, the negative polarity AC signal compensator 190*b* operates as a current mirror, because the third and fourth diodes D3 and D4 are shorted by the negative polarity AC signal. Accordingly, the electric current difference between the negative polarity AC signals through the first and second lamps 181*a* and 181*b* of a parallel connection configuration may be prevented or minimized.

Figure 3:
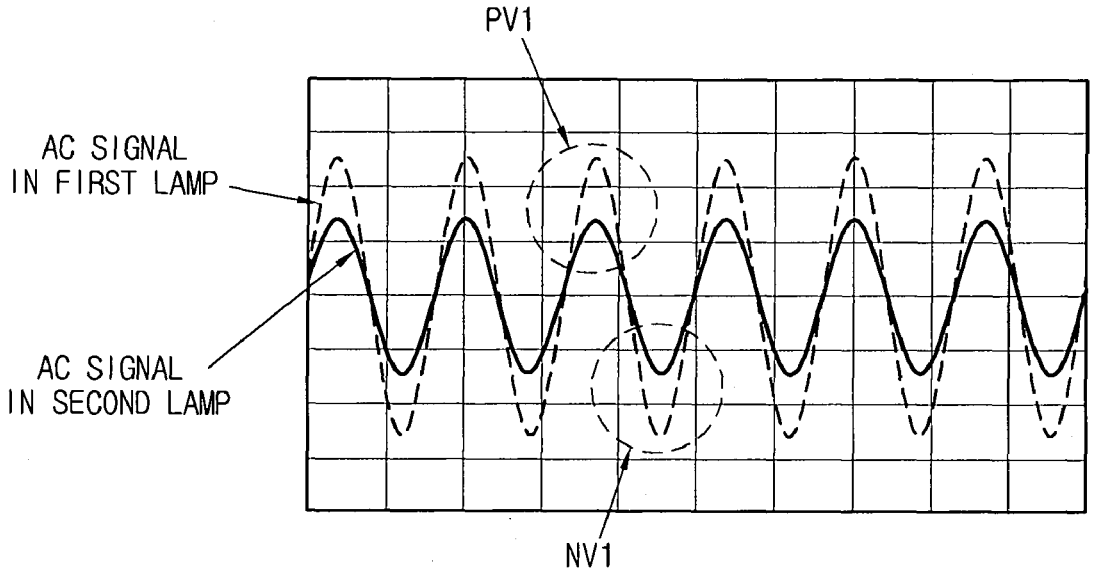
FIG. 3 is a view showing alternating current signals which are applied from the inverter of the related art backlight unit to first and second lamps.
Figure 4:
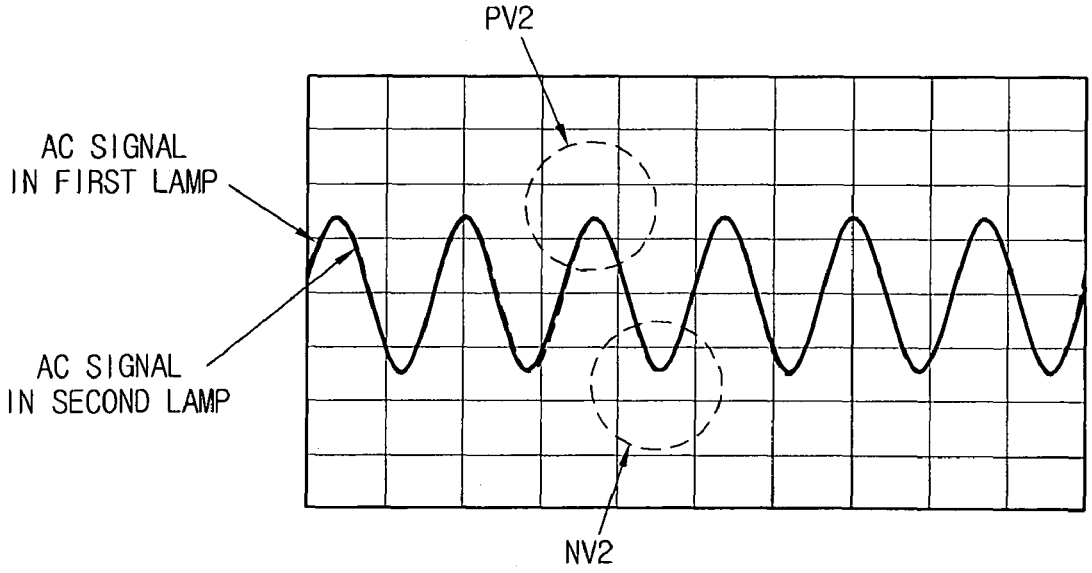
FIG. 4 is a view showing alternating current signals which are applied from the inverter of the backlight unit according to the embodiment of the present disclosure to first and second lamps.

FIG. 3 is a view showing alternating current signals which are applied from the inverter of the related art backlight unit to the first and second lamps. FIG. 4 is a view showing alternating current signals which are applied from the inverter of the backlight unit according to the embodiment of the present disclosure to the first and second lamps.

As shown in FIG. 3, an electric current difference between the AC signals flowing through the first and second lamps of the related art backlight unit is caused by the different impedances of the first and second lamps. The electric current difference includes a positive polarity electric current difference in the positive polarity AC signal region and a negative polarity electric current difference generated in the negative polarity AC signal region. The positive polarity electric current difference is greatly generated as shown in PV1 of FIG. 3. Also, the negative polarity electric current difference is greatly developed as NV1 of FIG. 3. Accordingly, in the related art backlight unit, the lightness of the first lamp is different from that of the second lamp due to the positive and negative polarity electric current differences.

On the other hand, an electric current difference between the AC signals flowing through the first and second lamps of the backlight unit according to the embodiment of the present disclosure is hardly generated as shown in FIG. 4. More specifically, when the positive polarity AC signal is applied the first and second lamps, a positive polarity electric current difference is hardly generated due to the compensating operation of the positive polarity AC signal compensator 190*a*, as shown in PV2 of FIG. 4. Similarly, a negative polarity electric current difference is hardly developed due to the compensating operation of the negative polarity AC signal compensator 190*b*, as NV2 of FIG. 4. Consequently, the backlight unit driver according to the embodiment of the present disclosure can minimize or eliminate the electric current difference between the first and second lamps.

As described above, the backlight unit driver according to the embodiment of present disclosure can reduce or eliminate effectively and with low-cost the electric current difference between the first and second lamps connected with each other. This results from the fact that the backlight unit driver includes the positive polarity AC signal compensator compensating the difference between the positive polarity AC signals, and the negative polarity AC signal compensator compensating the difference between the negative polarity AC signals. Also, the backlight unit driver can compensate the electric current difference between the lamps, regardless of the polarity of the AC signal.

It will be apparent to those skilled in the art that various modifications and variations can be made in the present disclosure. Thus, the present disclosure may not be limited to the above embodiment. Furthermore, it is intended that the present disclosure cover the modifications and variations of this embodiment provided they come within the scope of the appended claims and their equivalents.

What is claimed is:

1. A driver for a backlight unit comprising:

a first and a second lamps connected parallel to each other;

a DC/AC inversion portion inverting a DC voltage into an AC voltage to apply the AC voltage to the lamps;

a frequency controller controlling the DC/AC inversion portion to stably output the AC voltage of a fixed frequency;

a transformer transforming the AC voltage from the DC/AC inversion portion;

a positive polarity AC signal compensator compensating a positive electric current difference between the first and the second lamps using positive polarity AC signals from the first and the second lamps; and a negative polarity AC signal compensator compensating a negative electric current difference between the first and the second lamps using negative polarity AC signals from the first and the second lamps, wherein the positive polarity AC signal compensator includes:

a first and a second diodes connected to one end of the first and the second lamps and being shorted by a positive polarity AC signal, a first transistor including a first collector connected to the first diode and a first base directly connected to the first collector, a second transistor including a second collector connected to the second diode and a second base connected to the first base of the first transistor, a first and a second resistors each connected between a first and a second emitters of the first and the second transistors, respectively, and a ground electric current source.

2. The driver claimed as claim 1, wherein the first and the second transistors are N-type transistors.

3. The driver claimed as claim 1, wherein the negative polarity AC signal compensator includes:

a third and a fourth diodes connected to one end of the first and the second lamps and being shorted by a negative polarity AC signal;

a third transistor including a third collector connected to the third diode and a third base connected to the third collector; and a fourth transistor including a fourth collector connected to the fourth diode and a fourth base connected to the third base of the third transistor.

4. The driver claimed as claim 3, wherein the negative polarity AC signal compensator further includes a third and a fourth resistors each connected between a basic electric current source and emitters of the third and the fourth transistors, respectively.

5. The driver claimed as claim 3, wherein the third and the fourth transistors are P-type transistors.

* * * * *